US007089857B2

(12) United States Patent
Nouel

(10) Patent No.: US 7,089,857 B2
(45) Date of Patent: Aug. 15, 2006

(54) METHOD FOR COPYING A PRINTING PLATE FOR HUMID OFFSET PRINTING

(76) Inventor: Jean-Marie Nouel, Les Hauts de Busseau, F-77760, Villiers sous Grez (FR)

( * ) Notice: Subject to any disclaimer, the term of this patent is extended or adjusted under 35 U.S.C. 154(b) by 0 days.

(21) Appl. No.: 10/524,120

(22) PCT Filed: Aug. 12, 2003

(86) PCT No.: PCT/FR03/02511

§ 371 (c)(1),
(2), (4) Date: Feb. 10, 2005

(87) PCT Pub. No.: WO2004/016428

PCT Pub. Date: Feb. 26, 2004

(65) Prior Publication Data

US 2005/0204944 A1 Sep. 22, 2005

(30) Foreign Application Priority Data

Aug. 13, 2002 (FR) ..... 02 10250

(51) Int. Cl.
*B41N 3/08* (2006.01)
*B41N 1/08* (2006.01)

(52) U.S. Cl. ..... 101/463.1; 101/465; 101/466

(58) Field of Classification Search ..... 101/463.1, 101/465, 466
See application file for complete search history.

(56) References Cited

U.S. PATENT DOCUMENTS

| | | | | |
|---|---|---|---|---|
| 5,655,446 | A * | 8/1997 | Watanabe | 101/128.21 |
| 6,315,916 | B1 | 11/2001 | Deutsch et al. | |
| 2001/0050702 | A1 | 12/2001 | Nakazawa et al. | |
| 2003/0085972 | A1 * | 5/2003 | Schaschek et al. | 347/101 |

FOREIGN PATENT DOCUMENTS

JP 10119230 A * 5/1998

* cited by examiner

*Primary Examiner*—Daniel J. Colilla
*Assistant Examiner*—Joshua Zimmerman
(74) *Attorney, Agent, or Firm*—Dennison, Schultz & MacDonald

(57) ABSTRACT

The present invention concerns an original method of copying a printing plate. Said plate, intended for wet offset printing, comprises a base substrate and a photosensitive layer which is soluble in a solvent.

As is conventional, said method comprises selectively eliminating said photosensitive layer at suitable locations and is characterized in that said selective elimination comprises: depositing droplets of said solvent at said suitable locations; and rinsing the plate to evacuate the deposited solvent, which by then is charged with the photosensitive layer eliminated from said locations and is inactive.

9 Claims, No Drawings

METHOD FOR COPYING A PRINTING PLATE FOR HUMID OFFSET PRINTING

This application is a filing under 35 USC 371 of PCT/FR2003/002511, filed Aug. 12, 2003.

The present invention relates to a method of copying a printing plate for wet offset printing.

Derived from lithography and based on the transfer of oil-based inks that adhere to ink-accepting surfaces and that do not adhere to wet hydrophilic surfaces, wet offset printing methods use plates (made of steel or, principally, of electrograined and anodized aluminum) which have a hydrophilic surface; when wet, the hydrophilic surface does not take up ink. To improve its hydrophilic nature, said hydrophilic surface has generally been treated.

The hydrophilic surface of said plates is coated with an ink-accepting layer based on a photosensitive ink-accepting lacquer that can take up ink. Said layer is generally 1.4 micrometers (μm) to 2.7 μm thick. Said lacquer is generally photosensitive to light with a wavelength in the range 320 nanometers (nm) to 450 nm.

Conventionally, a frame and suitable lamps are used to expose the lacquer on such plates, through silver films which have opaque surfaces and transparent surfaces which (in the main) represent the motifs to be printed. Said exposed lacquer is then developed with a developer. The portions of the plate where it remains will take up ink; the portions of the plate where it has been eliminated uncover the hydrophilic surface of said plate.

If the lacquer in question is a negative lacquer, then in the portions which have been exposed through the transparent surfaces of the negative film used, it is hardened and rendered insoluble in the developer. In the non exposed portions, it does not harden and it remains soluble in the developer and is thus removed by said developer on developing.

If the lacquer in question is a positive lacquer, then the portions which have been exposed through the transparent surfaces of the positive film used become soluble in the developer. On development, it is removed by said developer. In the non exposed portions, it is not rendered soluble in said developer. It remains on developing.

After exposing and developing (the photosensitive ink-accepting lacquer-based layer which initially covers it uniformly has in fact been exposed and developed), the plate is fixed on the printing press. Rollers wet the hydrophilic surfaces (zones from which the ink-accepting lacquer has been removed) and other rollers deposit ink on the ink-accepting lacquer (in the zones where it remains). Said ink is then taken from said ink-accepting zones of said plate by the rubbery surface of a blanket with a fabric or metal support which finally deposits it on the surface to be printed: paper, cardboard, metal, etc.

That printing technology and the materials it uses to carry it out are familiar to the skilled person. Many patent documents have been written on these subjects over the past 40 years or more.

Thus:

– positive lacquers are generally constituted by phenolic or Resol® type resins (Novolac® resins, for example), which are intrinsically soluble in alkaline aqueous solutions and which are rendered insoluble in said alkaline aqueous solutions at the usual working temperatures (20–25° C.) by adding thereto an effective quantity of at least one solubility inhibitor. Such solubility inhibitors are well known to the skilled person. The commercial agencies of the supplier SiberHegmer market the following:

+ the sodium salt of 2-diazo-1-naphtol-4-sulfonic acid, monohydrate (CAS No. 64173-96-2);

+ the sodium salt of 2-diazo-1-naphtol-5-sulfonic acid (CAS No. 2857-00-3);

+ a mixture: ester of 2-diazo-1-naphtol-4-sulfone and 2,3,4-trihydroxybenzophenone (CAS No. 107761-81-9);

+ an ester of 2-diazo-1-naphtol-4-sulfone incorporated into a 4-cresol resin (CAS No. 80296-78-2).

The resins are generally charged with coloring agents, wetting agent(s), etc. For spreading on the plate (steel or aluminum), they are used in a solvent such as a ketone or a Cellosolve® type solvent.

Many patents, and in particular United States patents U.S. Pat. No. 3,635,709, U.S. Pat. No. 3,046,120 (and 121, and 122), U.S. Pat. No. 3,188,210 and U.S. Pat. No. 4,259,434 describe such positive lacquers.

The surfaces of said positive lacquers advantageously have small particles intended to facilitate lacquer-silver film contact in the exposure frame.

During exposure, the solubility inhibitor(s) present is(are) neutralized by the action of light. The exposed portions are rendered soluble in the developer, while the non exposed portions remain insoluble in said developer (at the usual working temperatures of said developer).

Positive lacquer developers (alkaline aqueous solutions) generally have a pH in the range 10.5 to 13.5.

Positive pre-sensitized (wet) offset plates are used worldwide;

negative lacquers are generally constituted by resins which are intrinsically soluble in alkaline aqueous solutions, which comprise an effective quantity of at least one insolublizing agent. After activating, such an agent renders them insoluble in said solutions. Said "activated" agent (under the action of light) renders said resins insoluble by causing their polymerization and/or curing. Such agents, for example diazo compounds, are well known to the skilled person.

Said resins are also generally charged with coloring agent(s), wetting agent(s) etc. For spreading on the plate, they are also generally used with a solvent. They have also been described in many patents.

Certain negative lacquers are protected from oxygen in the air by a transparent barrier layer based on polyvinyl alcohol.

The "activated" insolublizing agents induce polymerization and/or curing of the resin, rendering it insoluble in the developer. The exposed portions, rendered hard and resistant, are insoluble in the developer, while the non exposed portions remain soluble in said developer.

Negative lacquer developers (alkaline aqueous solutions) also have a basic pH, generally in the range 7.5 to 10. Different types exist. Some have been described in U.S. Pat. No. 4,123,276 and U.S. Pat. No. 5,466,559.

Negative pre-sensitized (wet) offset plates are used worldwide.

According to the technique summarized above, which is widely used in the prior art, the preparation of wet offset plates to copy the motif to be printed thereto thus comprises a preliminary step of producing a positive or negative film and a step of exposing the photosensitive ink-accepting lacquer of said plates through said film.

More recently, the use of the silver film has been dispensed with, and thus the exposure step in the unit has also been discarded. Photosensitive ink-accepting lacquers are exposed directly with UV or IR lasers controlled by computers. The technology employed is termed "computer to plate" technology.

That technology has a number of substantial advantages, primarily related to the quality of the work obtained and the speed of execution, but it is expensive to use (imagers [computers] are expensive, as is the technical expertise required).

Inkjet technology is used in some computer printers, particularly to produce monochrome or colored proofs, posters, advertisements, etc.

Inkjet machines generally operate in four, six or eight colors. For multi-color printing, one color per head is generally employed. For mono-color printing, the single color may be used in a plurality of heads, making it faster. The quality of the impressions obtained is good and is constantly improving. That technique of projecting the ink directly onto the substrate to be printed is widely used, particularly for small print runs.

Inkjet printheads using piezo technology are capable of projecting a 1440×1440 dpi (dots per inch) jet, i.e. of generating tiny inked surfaces with areas of less than 980 $\mu m^2$. It is possible to adjust the dimensions of the projected droplets (from 1 picoliter to more than 60 picoliters) to produce impact surfaces with various diameters (30, 40, 50, 65, 70, 85 μm, for example), etc.

Patent documents, in particular European patent applications EP-A-0 697 282, EP-A-1 120 248, EP-A-1 157 825, EP-A-1 157 827, EP-A-1 157 828, International patent application WO-A-0073065 and U.S. patents U.S. Pat. No. 6,080,449 and U.S. Pat. No. 6,136,889, describe the use of inkjet technology to copy printing plates for wet offset printing. A suitable solution, generally ink-accepting, is then projected over said plates. In practice, there are many difficulties:

- the nature of the projected solution has to be optimized, particularly as regards the printhead spray nozzles which clog up readily; and
- despite the opportune use of a sub-layer on the plate, it is difficult to obtain a sufficiently thick adhesive deposit of solution that does not spread and that can withstand the printing press.

U.S. Pat. No. 6,315,916 describes a method of copying a pre-sensitized wet offset plate coated with a negative photosensitive ink-accepting lacquer. According to that method, an alkaline aqueous solution (the pH of which is generally in the range 7.5 to 13.5) is projected into regions in which the negative photosensitive ink-accepting lacquer has to remain on said plate to take up ink. According to that method:

- said alkaline aqueous solution is projected;
- the plate in question is heated to a temperature in the range 90° C. to 130° C. for 15 seconds (s) to 3 minutes (min);
- it is developed with a conventional developer for that type of plate and rinsed with water.

The surfaces of the lacquer which have not been rendered insoluble by the projected solution are eliminated on developing/rinsing. The copied plate has surfaces of ink-accepting lacquer intended to take up ink and hydrophilic surfaces (from which the lacquer has been eliminated) which, when wet, will not take up ink.

WO-A-0 178 984 describes a method of copying a printing plate intended for printing using the water-less offset technique. Such a plate has, on a suitable support, an ink-accepting layer and a layer (based on silicones) which repels ink applied to the preceding layer. In accordance with the described copying method, a developing liquid is projected onto said (upper) layer, which repels the ink at regions corresponding to the motifs to be printed, then said charged developing liquid is eliminated (thus denuding the [lower] ink-accepting layer at regions corresponding to said printing motifs). Since the developing liquid remains active during elimination thereof, its elimination is unavoidably imperfectly selective. The quality of printing is inexorably affected. The skilled person is also aware that the printing technical fields in water-less offset and wet offset are distinct technical fields. As indicated above and developed in more detail below, the context of the invention is that of wet offset.

In such a context, the Applicant has conceived and developed the invention claimed below. It concerns an original method of copying printing plates intended for printing using wet offset printing.

Conventionally, as indicated above:

- the plates in question comprise a base substrate which has a hydrophilic surface coated with a photosensitive ink-accepting layer based on an ink-accepting lacquer which is soluble in a solvent;
- the claimed copying method comprises selectively eliminating the ink-accepting layer at appropriate locations. Said appropriate locations clearly primarily or solely consist of those which do not correspond to the motifs to be printed. However, they can also include small surfaces (lightening surfaces) in zones which correspond to the motifs to be printed. The Applicant's patent application FR-A-2 660 245 filed on Apr. 3, 1990 actually describes the principle of lightening in printing (introducing small non ink-accepting surfaces, i.e. non printing surfaces, into ink-accepting printing surfaces). The Applicant thus developed a completely original and satisfactory technique for performing said lightening in dry or wet offset. That technique, described in WO-A-96 02868 involves, for said lightening, small surfaces (small dots) distributed randomly in a stochastic pattern. When copying lightened plates, there is also partial elimination of the ink-accepting layer in locations corresponding to the motifs to be printed (said locations are thus lightened).

In a completely original manner:

- said selective elimination of the ink-accepting layer comprises no step for exposure thereof (neither through a silver film nor with UV or IR lasers); and
- said selective elimination of the ink-accepting layer comprises depositing droplets of solvent at said appropriate locations and rinsing the plate to evacuate the deposited solvent, which is then charged with the ink-accepting lacquer eliminated from said locations and inactive (so that said ink-accepting lacquer is eliminated from said locations and only from said locations).

Characteristically, in accordance with the invention, a solvent for the ink-accepting layer is employed directly, to denude the base substrate of the plate at locations which do not correspond to the motifs to be printed and optionally, in addition, at small lightening surfaces in locations corresponding to the motifs to be printed. Said charged solvent is eliminated in a perfectly selective manner because it is inactive (without effect) during rinsing.

For elimination on rinsing, the solvent is inactive. In accordance with a first variation, it is inactive per se. As an example, on positive plates, used hot (active), it is then cooled (inactive). In a second variation, it is taken into a new context in which it is inactive. The change in context generally results from a change of state of the plate in question, for example regarding the temperature of said plate (positive plate) or the state of the photosensitive layer of said plate (negative plate).

Depending on the type of plate in question, and more precisely the type of photosensitive layer in question, the conditions for using the solvent, in the active state and to eliminate it in the inactive state, are adjusted.

Insofar as the action of the solvent remains highly focused, the method of the invention is suitable both for copying conventional plates and for copying lightened plates.

The nature of the solvent in question clearly has to be optimized as a function of the nature of the ink-accepting lacquer in question and as a function of the exact mode of use of said solvent.

A priori, it is an aqueous solvent which, so, has no affinity with the ink-accepting lacquer.

Advantageously, it is an alkaline or acidic aqueous solution, and particularly preferably an alkaline aqueous solution.

Logically, such an alkaline aqueous solution can consist of one (or be of the type of) developer(s) in current use with pre-sensitized plates.

Advantageously, when carrying out the method of the invention, when used as a solvent, positive developers (alkaline aqueous solutions the pH of which is generally in the range 10.5 to 13.5) and negative developers (alkaline aqueous solutions the pH of which is generally in the range 7.5 to 10) of the prior art are diluted; said developers being provided for open tank developing of a large number of plates. Their formulation is also advantageously modified or even simplified for their novel use in accordance with the invention. The solvents that can be used in the invention advantageously include additives such as drying retarding agents (said solvents must be able to be deposited, react and be evacuated, charged, preferably before drying).

The use of acidic aqueous solutions as a solvent has also been mentioned.

Such use must clearly be compatible with the nature of the ink-accepting lacquer in question but also with the overall printing method. Ink-accepting lacquers, soluble in an acidic aqueous solution, are to be used either with alkaline wetting liquids or after heat treatment, which renders them insoluble, in acidic wetting liquids.

The deposited solvent generally acts rapidly. It is evacuated, charged and inactive, as indicated above, by rinsing. Said rinsing is generally carried out with water, in particular in the contexts described above using an aqueous solvent. Said rinsing can use a large amount of water and may be mechanically assisted. Brushes, as is routine in press rooms, may be involved to enhance their action.

The droplets of solvent deposited when carrying out the copying method of the invention generally have a volume (capacity) in the range 1 picoliter to 100 picoliters, advantageously in the range 4 picoliters to 30 picoliters. Said droplets do not necessarily all have the same volume. In the context of carrying out the method of the invention, droplets of different volumes may be deposited together.

Said droplets are generally deposited under conditions which involve droplet/ink-accepting lacquer impact surfaces the mean diameter(s) of which is/are in the range 10 μm to 150 μm, advantageously in the range 30 μm to 85 μm.

Depending on the nature and desired quality of the work, the skilled person can optimize the size of said droplets and their mode of deposition. Referring to said mode of deposition—the novel use of the solvent for the ink-accepting lacquer of the invention—the following non-limiting notes can be provided.

The droplets of solvent may be deposited, in particular projected, using any appropriate technique, in particular by inkjet. More precisely, in an advantageous variation, droplet deposition is ensured by an inkjet printhead. In fact, a solvent for ink-accepting lacquer rather than ink is deposited. To this end, an inkjet printhead is advantageously employed. The introduction to the present text mentions this type of device, currently used to print directly onto a support.

Inkjet technology is developing rapidly. It is particularly suitable for ink based on aqueous solutions.

The invention proposes a completely original field of application to said technology.

More particularly, the method of the invention has been tested with a machine of this type, a "High Fidelity Inkjet Printer" from ROLAND, Model FJ-500/FJ-400, having piezo inkjet printheads and using recent twin head technology with variable dot diameter. It can be used in various resolutions, in particular that of 1440×1440 dpi (dots per inch) as already mentioned. A carriage equipped with inkjet heads (projection nozzles) reciprocates regularly and laterally. It can produce regular deposits of solvent on a plate which is passed by, supported on plates at the inlet and outlet. The solvent in question is advantageously used in a plurality of heads.

In a further device, the plate is fixed and the carriage with the inkjet heads is displaced laterally and progresses over the whole length of the plate.

Inkjet printing is a printing technique that is familiar to the skilled person. The method of the invention offers an original market for this technique. In accordance with said method of the invention, instead of inkjets, solvent jets are used; once charged, the projected solvent is then eliminated.

The method of the invention as described above and as illustrated, in a non limiting manner, in the examples below can be employed with any type of plate of the type described above (comprising a base substrate which has a hydrophilic surface coated with an ink-accepting photosensitive layer based on an ink-accepting lacquer which is intrinsically soluble in a solvent), and in particular, pre-sensitized plates in current use (positive plates and negative plates comprising a photosensitive ink-accepting layer).

The method of the invention essentially consists of the two operations defined above: deposition of droplets of solvent and rinsing to eliminate the charged deposited solvent; clearly, said rinsing is only carried out after the solvent has acted and its action is complete.

Whatever the context of the method of the invention, the skilled person can optimize the timing and conditions of the rinsing operation.

The method of the invention carried out with prior art plates—pre-sensitized plates (the main type of plate currently in use)—comprises the operations summarized above, modified and/or supplemented to take into account the photosensitivity of the ink-accepting lacquer in question.

Thus:

– the method of the invention, carried out to copy a positive plate the ink-accepting layer of which is photosensitive, said layer comprising an effective quantity of at least one solubility inhibitor, comprises:

· using solvent under conditions in which the action of said inhibitor is neutralized. More particularly, the following conditions are recommended:

+ the droplets of said solvent are deposited on the plate heated to a temperature in the range 40° C. to 90° C., advantageously in the range 55° C. to 65° C.; and/or + the droplets of said solvent are deposited on the plate heated to a temperature in the range 40° C. to 90° C., advantageously in the range 55° C. to 65° C.;

· rinsing said plate to evacuate said solvent, which is then charged with dissolved ink-accepting lacquer, and became inactive under suitable temperature conditions of the plate and/or of said solvent.

Using hot solvent and/or solvent on a hot plate is particularly advantageous since it involves a highly targeted action of said solvent. When carrying out the rinsing, said hot solvent has cooled and/or said hot plate has cooled, so said solvent is definitely inactive.

The use of solvent on a positive pre-exposed plate is almost excluded as it unavoidably involves action of said solvent, which is far less targeted. Clearly, when rinsing, the solvent, which remains active, is still acting;

– when carried out to copy a negative plate the ink-accepting layer of which is photosensitive, said layer comprising an effective quantity of at least one insolublizing agent, the method of the invention is carried out as indicated below.

After deposition (projection) of the droplets of solvent, the plate is treated to cause the ink-accepting layer to harden at locations which are not coated (not protected) by said droplets. The treatment in question involves light. It consists of exposure. The treated plate is then rinsed and dried in succession.

The action of the solvent is thus perfectly targeted, and fine motifs can be reproduced. Rinsing is carried out after treatment and thus without risking removing some of the ink-accepting lacquer from regions where it should remain.

Regardless of the exact mode of carrying out the method of the invention, it may be opportune to supplement it by baking the copied plate. This is aimed at consolidating the copied ink-accepting layer. Baking is a conventional technique carried out to allow a large amount of prints.

The copying method of the invention, which is advantageously carried out using a printing technique (inkjet printing), has surprisingly proved to be particularly powerful.

The satisfactory results obtained are not in any way obvious. In fact:

– the solvent has proved to be capable of removing a large amount of the ink-accepting lacquer. The skilled person will be aware that the inked surfaces of the plates are generally much smaller than non-inked surfaces. Thus, the text surface in a book is much smaller than the virgin ink-free white surface of said book;

– said solvent has proved to be capable of developing its action in a highly targeted manner. It does not remove a little more ink-accepting lacquer in dark portions where the surfaces of the ink-accepting lacquers to be removed are very small and the very small surfaces of ink-accepting lacquers in light tints are not removed, even though they are completely surrounded when the solvent in question develops its action;

– coalescence of the droplets of solvent used has been avoided.

The quality of reproductions produced with copied plates in accordance with the method of the invention are comparable with that of reproductions obtained conventionally (with the same definition) with exposed photosensitive plates.

The copying method of the invention is a reliable, economic, ecological, simple-to-use method. No expensive equipment is required to carry it out. It can copy plates at an advantageous price.

The invention has been described above with reference to pre-sensitized plates that are in the most frequent current use: positive and negative plates comprising a photosensitive ink-accepting layer on a (metallic) base with a hydrophilic surface. The skilled person will readily appreciate that it is not strictly limited to this context.

The present invention has a further market in the field of plates with a bimetallic surface coated with a photosensitive layer termed a reserve layer. The skilled person will also know that type of plate.

The structure of said plates comprises a base substrate with a hydrophilic surface (generally made of aluminum with a matt surface or of stainless steel) coated with a fine metallic ink-accepting layer (generally a layer of copper about 2 μm thick), itself coated with a photosensitive layer (generally a lacquer).

To copy said plates, three steps are currently carried out:

the photosensitive layer is exposed;

the ink-accepting metallic layer (copper layer) is developed and thus denuded at suitable locations;

chemical attack (of copper by a solution based on iron perchloride) is carried out at the denuded locations to denude the hydrophilic surface of said plates.

In this context, the present invention (selective elimination of the photosensitive layer by depositing solvent and rinsing) advantageously substitutes for the first steps (exposure+development) of the prior art method summarized above.

It should be understood that the present invention can be analyzed overall as a method that improves copying of printing plates intended for printing using the wet offset technique. In accordance with this improved method, selective elimination of the photosensitive layer comprises: depositing droplets of solvent at suitable locations; and rinsing the plate to evacuate the deposited solvent, by then charged with photosensitive layer eliminated from said locations and inactive.

The invention will now be illustrated by the following non-limiting examples.

Examples 1 to 5 were carried out with droplets of alkaline aqueous solvent "A" or an alkaline aqueous solvent "B";

"A": aqueous solution with a pH of 13, conventionally used as a positive developer for positive pre-sensitized plates from LITHOPLATE (ES).

"B": aqueous solution with a pH of 9.5, conventionally used as a negative developer for negative pre-sensitized plates from LITHOPLATE (ES).

The droplets were deposited using a drop-counter or projected using inkjet printheads from a "High Fidelity Inkjet Printer" from ROLAND (model FJ 500/FJ 400). Said heads were supplied by cartridges comprising solvent "B".

EXAMPLE 1

Three droplets of solvent "A" were deposited on the positive ink-accepting lacquer (blue in color, thickness 2.5 μm) of a positive pre-sensitized plate from LITHOPLATE (ES), which was respectively heated to:

–30° C.: no change observed (t=60 seconds (s));

–55° C.: the droplets were left for 30 s. After rinsing with water, a slight blue tint remained, proof that lacquer remained on the hydrophilic aluminum of the plate (at locations where the droplets were employed);

–55° C.*: the droplets were left for 60 s. After rinsing with water, it was observed that all of the lacquer had gone (at locations where the droplets were employed);

–65° C.*: the droplets were left for 30 s. After rinsing with water, it was observed that all of the lacquer had gone (at locations where the droplets were employed).

The above rinses were carried out on the cooled plate.

*The solubility inhibitor present in the lacquer of the plate was neutralized at these plate temperatures.

EXAMPLE 2

The procedure of Example 1 was used, except that the plate was not heated and solvent "A" was used at a temperature of 80° C. Said hot solvent "A" was left on the plate (unheated) for 60 s. It cooled and became inactive. After rinsing with water, it was observed that all of the lacquer had gone (at locations where the droplets were employed).

The solubility inhibitor present in the lacquer of the plate was neutralized at the temperature at which the alkaline aqueous solvent was used.

EXAMPLE 3

The procedure of Examples 1 and 2 were used, more precisely:

by heating the plate to 40° C.; and by depositing the solvent "A" at 40° C.

Said heated solvent "A" was then left on the heated plate for 180 s. The whole was allowed to cool and it was rinsed.

A highly satisfactory result was obtained.

EXAMPLE 4

Three droplets of solvent "B" were deposited on the negative ink-accepting lacquer (blue in color, thickness 1.5 μm) of a negative pre-sensitized plate from LITHOPLATE (ES).

Said solvent "B" was allowed to act for 15 s and the whole surface of the negative lacquer was exposed to render hard and insoluble said surface which was not coated with said solvent "B".

The plate was then rinsed with water. The lacquer had gone from the droplet regions. In other regions, it remained, highly resistant because of the exposure.

EXAMPLE 5

Example 4 was reproduced on an industrial scale using the inkjet printheads identified above.

The droplets of solvent "B" projected by said printer had a volume of 24 picoliters. The diameter of their impact surface was 55 μm.

The digital recording represented texts in Times New Roman (14).

The negative plate used (LITHOPLATE) had the following dimensions 510×400×0.30 (mm).

The droplets of solvent "B" were projected and the surface of the plate was then exposed in a conventional manner with suitable light emitting tubes so that the surfaces not coated with said solvent "B" were rendered hard and insoluble.

The plate was then rinsed with water and dried.

A visual examination indicated very good text copying.

The negative plates were manipulated in yellow ambient light in this example.

EXAMPLE 6

The plate used was an aluminum plate (dimensions: 510×400×0.30 mm) with a hydrophilic treated surface successively coated with a layer of ink-accepting copper (about 2 μm thick) then with a negative photosensitive layer. It is sold by the company "Printing Developments Inc (PDI) (Racine USA).

The solvent used was the developer for said photosensitive layer. It was projected in the form of droplets with a volume of about 40 picoliters. The impact surface of said droplets had a mean diameter of about 60 μm.

Projection was carried out using a digital recording which represented texts in Times New Roman (16).

The plate was then exposed so that the photosensitive layer was rendered insoluble in the developer, with exposure clearly only acting on the surfaces of said photosensitive layer not covered by the solvent.

The plate was then rinsed, dried and coated with a solution of copper etch supplied by PDI. That solution eliminated the copper from the regions rendered accessible by elimination of the photosensitive layer and denuded the hydrophilic aluminum at those same regions.

After rinsing and, if appropriate, eliminating the photosensitive layer by action of a suitable solvent, the plate had an ink-accepting surface (Cu) and a hydrophilic surface (its treated surface) which could be wetted to repel ink.

A visual examination showed that the copy was good. The plate was suitable for several million prints.

The invention claimed is:

1. A method of copying a printing plate intended for printing using the wet offset technique, said plate comprising a base substrate and a photosensitive layer which is soluble in a solvent, said method comprising selectively eliminating said photosensitive layer at suitable locations and being characterized in that said selective elimination comprises: depositing droplets of said solvent at said suitable locations; and rinsing the plate to evacuate the deposited solvent which by then is charged with the photosensitive layer eliminated from said locations and is inactive.

2. The method according to claim 1 for copying a printing plate, comprising a metallic base substrate which has a hydrophilic surface coated with an ink-accepting metallic layer which is itself coated with a photosensitive layer which is soluble in a solvent, said method comprising said selectively eliminating said photosensitive layer, followed by chemical attack of said ink-accepting metallic layer which has been denuded at suitable locations.

3. The method according to claim 1 for copying a printing plate intended for printing using the wet offset technique, said plate comprising a base substrate which has a hydrophilic surface coated with a photosensitive ink-accepting layer based on an ink-accepting lacquer which is soluble in the solvent; said method comprising selectively eliminating said ink-accepting layer at suitable locations and being characterized in that said selective elimination comprises: depositing droplets of said solvent at said suitable locations; and rinsing the plate to evacuate the deposited solvent which by then is charged with the layer eliminated from said locations and is inactive.

4. The method according to claim 3, carried out to copy a positive plate the ink-accepting layer of which is photosensitive, said layer comprising an effective quantity of at least one solubility inhibitor, characterized in that said solvent is employed under conditions in which the action of said inhibitor is neutralized; the droplets of said solvent being deposited on the plate heated to a temperature in the range 40° C. to 90° C., advantageously in the range 55° C. to 65° C.; and/or the droplets of said solvent being deposited on the plate heated to a temperature in the range 40° C. to 90° C., advantageously in the range 55° C. to 65° C.; and in that said solvent is evacuated, by rinsing, at a plate and/or solvent temperature at which the solvent is inactive.

5. The method according to claim 3, carried out to copy a negative plate the ink-accepting layer of which is photosensitive, said layer comprising an effective quantity of at least one insolublizing agent, characterized in that said deposition of droplets is followed by a treatment causing hardening of the ink-accepting layer at locations not covered by said droplets; said treatment being followed by said rinsing then by drying.

6. The method according to claim 3, characterized in that it further comprises baking the copied plate.

7. The method according to claim 1, characterized in that the deposited droplets comprise droplets of an alkaline or acidic aqueous solution, advantageously alkaline, and in that said rinsing is with water.

8. The method according to claim 1, characterized in that the volume(s) of said droplets is(are) in the range 1 picoliter to 100 picoliters, advantageously in the range 4 picoliters to 30 picoliters, and they are deposited under conditions which produce droplet/photosensitive layer contact surfaces the mean diameter(s) of which is (are) in the range 10 um to 150 μm, advantageously in the range 30 μm to 85 μm.

9. The method according to claim 1, characterized in that said deposition of droplets is carried out using an inkjet printhead.

* * * * *